US009505209B2

(12) United States Patent
Kanasugi et al.

(10) Patent No.: US 9,505,209 B2
(45) Date of Patent: Nov. 29, 2016

(54) IMAGE-RECORDING METHOD

(71) Applicant: CANON KABUSHIKI KAISHA, Tokyo (JP)

(72) Inventors: Yuichiro Kanasugi, Tokyo (JP); Mitsutoshi Noguchi, Kawaguchi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/732,556

(22) Filed: Jun. 5, 2015

(65) Prior Publication Data

US 2015/0352836 A1 Dec. 10, 2015

(30) Foreign Application Priority Data

Jun. 10, 2014 (JP) ..... 2014-120002

(51) Int. Cl.
*B41J 2/01* (2006.01)

(52) U.S. Cl.
CPC ..... *B41J 2/01* (2013.01); *B41J 2002/012* (2013.01)

(58) Field of Classification Search
CPC ..... B41J 2/0057; B41J 2/01; B41J 2/17593; B41J 29/17; B41J 2002/012
USPC ..... 347/103
See application file for complete search history.

(56) References Cited

U.S. PATENT DOCUMENTS

2009/0073222 A1* 3/2009 Hori ..... B41J 2/01 347/33
2009/0079784 A1* 3/2009 Chiwata ..... B41J 2/1606 347/21
2010/0225719 A1* 9/2010 Takatsuka ..... B41J 11/0085 347/102
2011/0242200 A1* 10/2011 Tojo ..... B41M 7/009 347/21

FOREIGN PATENT DOCUMENTS

JP 2009-83317 A 4/2009

* cited by examiner

*Primary Examiner* — Manish S Shah
*Assistant Examiner* — Yaovi M Ameh
(74) *Attorney, Agent, or Firm* — Canon U.S.A. Inc., IP Division

(57) ABSTRACT

An image-recording method includes a liquid composition applying process for applying a liquid composition to an intermediate transfer member, an intermediate image forming process for forming an intermediate image by applying an ink to the intermediate transfer member to which the liquid composition has been applied, and a transferring process for transferring the intermediate image to a recording medium. The ink contains a coloring material and first polymer particles, the liquid composition contains a reaction agent and second polymer particles that satisfy storage elastic modulus relationships represented by the formula (1), and the amount of the second polymer particles applied to the intermediate transfer member in the intermediate image forming process is 0.5 g/m$^2$ or more and 5.0 g/m$^2$ or less.

$$E1' \leq 0.1 \text{ MPa}, E2' \geq 1.0 \text{ MPa} \quad (1)$$

18 Claims, 1 Drawing Sheet

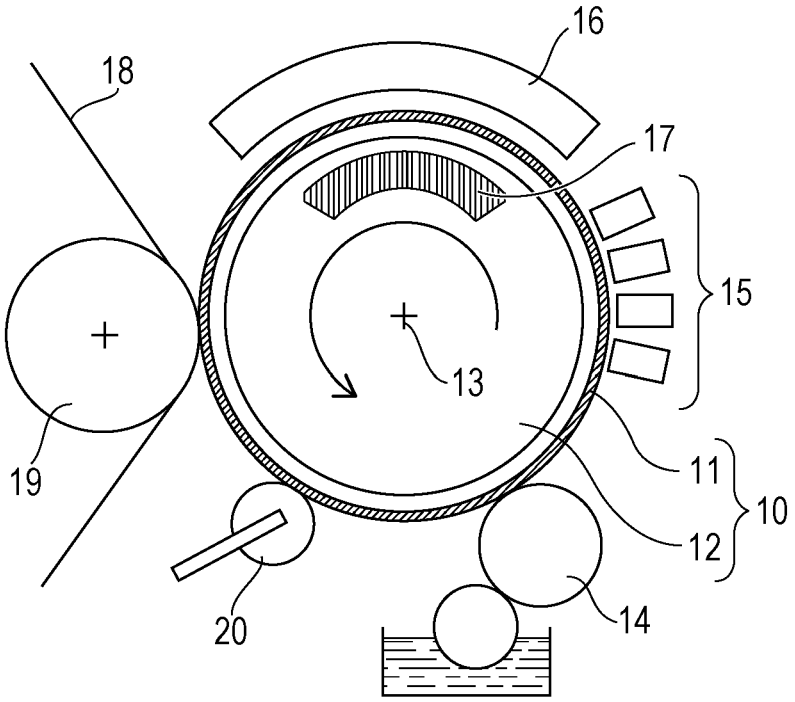
16
18
17
15
13
19
11
10
12
20
14

IMAGE-RECORDING METHOD

BACKGROUND OF THE INVENTION

1. Field of the Invention

The present invention relates to an image-recording method.

2. Description of the Related Art

In one known image-recording method, images are recorded by applying an ink to an intermediate transfer member to form an intermediate image and transferring the intermediate image to a recording medium (hereinafter also referred to as an "intermediate transfer type image-recording method"). In recent years, with the growing demand for high-speed recording, intermediate transfer type image-recording methods for recording high-quality images at high transfer speeds have been studied. In intermediate transfer type image-recording methods, image quality depends greatly on transfer efficiency with which an intermediate image on an intermediate transfer member is transferred to a recording medium. Japanese Patent Laid-Open No. 2009-83317 discloses a method for improving transfer efficiency using a liquid composition containing polymer particles. Japanese Patent Laid-Open No. 2009-83317 discloses that transfer efficiency is improved by lowering the surface temperature of an intermediate transfer member below the melting point of the polymer particles of the liquid composition and thereby reducing adhesion of an intermediate image to the intermediate transfer member resulting from melting of the polymer particles.

SUMMARY OF THE INVENTION

The present invention provides an image-recording method including a liquid composition applying process for applying a liquid composition to an intermediate transfer member, an intermediate image forming process for forming an intermediate image by applying an ink to the intermediate transfer member to which the liquid composition has been applied, and a transferring process for transferring the intermediate image to a recording medium. The ink contains a coloring material and first polymer particles, the liquid composition contains a reaction agent and second polymer particles that satisfy storage elastic modulus relationships represented by the following formula (1), and the amount of the second polymer particles applied to the intermediate transfer member in the intermediate image forming process is 0.5 g/m$^2$ or more and 5.0 g/m$^2$ or less:

$$E1' \leq 0.1 \text{ MPa}, \; E2' \geq 1.0 \text{ MPa} \qquad \text{Formula (1):}$$

wherein E1' denotes a storage elastic modulus at Ta, and E2' denotes a storage elastic modulus at ((Ta+Tb)*0.5), Ta denotes the temperature of the intermediate image before transfer in the transferring process, and Tb denotes the temperature of the recording medium before transfer in the transferring process.

Further features of the present invention will become apparent from the following description of exemplary embodiments with reference to the attached drawing.

BRIEF DESCRIPTION OF THE DRAWINGS

FIGURE is a schematic view of a recording apparatus for use in the present invention.

DESCRIPTION OF THE EMBODIMENTS

The present inventors studied the method described in Japanese Patent Laid-Open No. 2009-83317 and found that the transfer efficiency and image quality were unsatisfactory when the period during which an intermediate transfer member comes into contact with a recording medium with an intermediate image interposed therebetween and is separated from the recording medium (hereinafter also referred to as a "contact-separation time") is short or when a recording medium has a rough surface.

Thus, the present invention provides an image-recording method for recording high-quality images with high transfer efficiency even when the contact-separation time is short or even when a recording media having a rough surface is used.

The present invention will be further described with the embodiments. First, the present inventors studied characteristic requirements for high transfer efficiency in an intermediate transfer type image-recording method. As a result, (i) high adhesion strength of an intermediate image to a recording medium and (ii) high intermediate image strength were found to be important. Satisfying the characteristic requirement (i) facilitates transfer of an intermediate image to a recording medium. Satisfying the characteristic requirement (ii) reduces the likelihood that an intermediate image to be transferred from an intermediate transfer member to a recording medium will remain partly on the intermediate transfer member (hereinafter also referred to as a "transfer residue").

The present inventors studied the conditions for meeting these characteristic requirements (i) and (ii) and completed the present invention. More specifically, an image-recording method includes a liquid composition applying process for applying a liquid composition to an intermediate transfer member, an intermediate image forming process for forming an intermediate image by applying an ink to the intermediate transfer member to which the liquid composition has been applied, and a transferring process for transferring the intermediate image to a recording medium. The ink contains a coloring material and first polymer particles, the liquid composition contains a reaction agent and second polymer particles that satisfy storage elastic modulus relationships represented by the following formula (1), and the amount of the second polymer particles applied to the intermediate transfer member in the intermediate image forming process is 0.5 g/m$^2$ or more and 5.0 g/m$^2$ or less:

$$E1' \leq 0.1 \text{ MPa}, \; E2' \geq 1.0 \text{ MPa} \qquad \text{Formula (1):}$$

wherein E1' denotes a storage elastic modulus at Ta, and E2' denotes a storage elastic modulus at ((Ta+Tb)*0.5), Ta denotes the temperature of the intermediate image before transfer in the transferring process, and Tb denotes the temperature of the recording medium before transfer in the transferring process.

The mechanism by which such an image-recording method has the advantages of the present invention is described below.

At the temperature (Ta) of an intermediate image before transfer in the transferring process, the second polymer particles of a liquid composition according to an embodiment of the present invention have a storage elastic modulus of 0.1 MPa or less. When 0.5 g/m$^2$ or more and 5.0 g/m$^2$ or less of the second polymer particles having a storage elastic modulus in this range are applied to an intermediate transfer member, an intermediate image containing the second polymer particles can be easily deformed along the surface profile of a recording medium during contact with the recording medium. Deformation of the intermediate image increases the contact area between the intermediate image and the recording medium and increases the adhesion strength between the intermediate image and the recording medium (the characteristic requirement (i)). This is particularly effective when the recording medium has a rough surface profile.

At a temperature of ((Ta+Tb)*0.5), the second polymer particles of a liquid composition according to an embodiment of the present invention have a storage elastic modulus of 1.0 MPa or more. The temperature ((Ta+Tb)*0.5) is calculated from the temperature (Ta) of an intermediate image and the temperature (Tb) of a recording medium measured before transfer in the transferring process. The temperature ((Ta+Tb)*0.5) corresponds to the temperature of the intermediate image when the intermediate transfer member is separated from the recording medium with the intermediate image interposed therebetween. When 0.5 $g/m^2$ or more and 5.0 $g/m^2$ or less of the second polymer particles having a storage elastic modulus in this range are applied to an intermediate transfer member, an intermediate image containing the second polymer particles has increased strength, and the transfer residue after separation can be decrease (the characteristic requirement (ii)).

In an embodiment of the present invention, the characteristic requirements (i) and (ii) are satisfied by changing the storage elastic moduli of the second polymer particles so as to satisfy the formula (1) utilizing the temperature change of an intermediate image resulting from contact between the intermediate image and a recording medium in the transferring process and thereby controlling the deformability and strength of the intermediate image.

Thus, these constituents can synergistically produce their effects to achieve the advantages of the present invention.

Each process according to an embodiment of the present invention will be described in detail below.

[Liquid Composition Applying Process]

The liquid composition applying process for applying a liquid composition to an intermediate transfer member precedes the intermediate image forming process. A liquid composition can be applied to an intermediate transfer member by an applying method, such as a roller coating method, a bar coating method, or a spray coating method, or using an ink jet system. In particular, a liquid composition can be applied to an intermediate transfer member by an applying method.

<Intermediate Transfer Member>

In an embodiment of the present invention, the intermediate transfer member is a substrate that retains a liquid composition and an ink and on which an intermediate image is formed. The intermediate transfer member may include a supporting member and a surface layer member on which an intermediate image is to be formed. The supporting member is used to handle the intermediate transfer member and transmit power. The supporting member and the surface layer member may be integrated.

The intermediate transfer member may have a shape of a sheet, roll, drum, belt, or endless web. The intermediate transfer member may have any size depending on the size of a recording medium.

The supporting member of the intermediate transfer member should have sufficient strength in terms of conveyance accuracy and durability. The supporting member can be made of a metal, ceramic, or polymer. Among others, the supporting member can be made of aluminum, iron, stainless steel, acetal resin, epoxy resin, polyimide, polyethylene, polyethylene terephthalate, nylon, polyurethane, silica ceramic, or alumina ceramic. The supporting member made of one of these materials can have dimensional accuracy and rigidity to withstand transferring pressure, and have decreased operational inertia and improved control responsiveness. These materials may be used alone or in combination. An intermediate image on the surface layer member of the intermediate transfer member is transferred to a recording medium, such as a paper sheet, by pressure bonding. Thus, the surface layer member should have moderate elasticity. For example, when a paper sheet is used as a recording medium, the surface layer member preferably has a durometer type A hardness in the range of 10 degrees or more and 100 degrees or less, more preferably 20 degrees or more and 60 degrees or less, according to JIS K 6253.

The surface layer member of the intermediate transfer member can be made of a metal, ceramic, or polymer. Among others, the surface layer member can be made of polybutadiene rubber, nitrile rubber, chloroprene rubber, silicone rubber, fluorinated rubber, fluorosilicone rubber, urethane rubber, styrene elastomer, olefin elastomer, poly (vinyl chloride) elastomer, ester elastomer, amide elastomer, polyether, polyester, polystyrene, polycarbonate, a siloxane compound, or a perfluorocarbon compound. The surface layer member may be formed of layered materials. For example, the surface layer member may be formed of a silicone rubber layer stacked on an endless belt shaped urethane rubber sheet, a silicone rubber layer stacked on a polyethylene terephthalate film, or a siloxane compound layer stacked on a urethane rubber sheet.

The intermediate transfer member may be subjected to surface treatment. The surface treatment may be frame treatment, corona treatment, plasma treatment, polishing treatment, roughening treatment, active energy beam irradiation treatment, ozone treatment, surfactant treatment, or silane coupling treatment. These treatments may be performed in combination.

In order to suppress the flow of an intermediate image on the intermediate transfer member, the intermediate transfer member preferably has an arithmetic average roughness of 0.01 μm or more and 3 μm or less according to JIS B 0601:2001. The contact angle of water on a surface of the intermediate transfer member is preferably 50 degrees or more and 110 degrees or less, more preferably 60 degrees or more and 100 degrees or less.

<Liquid Composition>

In an embodiment of the present invention, the liquid composition may be colorless, milk white, or white so as not to affect images recorded by an ink. Thus, the ratio of the maximum absorbance to the minimum absorbance (maximum absorbance/minimum absorbance) in a visible light wavelength region in the range of 400 to 800 nm is preferably 1.0 or more and 2.0 or less. This means that the absorption peak is substantially absent or very small in the visible light wavelength region. In an embodiment of the present invention, the liquid composition may contain no coloring material. The absorbance of the liquid composition without dilution can be measured with Hitachi double-beam spectrophotometer U-2900 (manufactured by Hitachi High-Technologies Corporation). The absorbance may be measured after the liquid composition is diluted. This is because the maximum absorbance and the minimum absorbance of the liquid composition are proportional to the dilution ratio, and therefore the ratio of the maximum absorbance to the minimum absorbance (maximum absorbance/minimum absorbance) is independent of the dilution ratio.

Reaction Agent

In an embodiment of the present invention, the liquid composition contains a reaction agent that causes an ink component (coloring material or resin) to precipitate or aggregate. The reaction agent may be a conventionally known compound. Among others, the reaction agent can be at least one selected from polyvalent metal ions, organic acids, and cationic polymers. Use of at least one selected from polyvalent metal ions and organic acids can cause an ink component to precipitate or aggregate rapidly. The liquid composition can contain a plurality of reaction agents.

Specific examples of the polyvalent metal ions include, but are not limited to, divalent metal ions, such as $Ca^{2+}$, $CU^{2+}$, $Ni^{2+}$, $Mg^{2+}$, $Sr^{2+}$, $Ba^{2+}$, and $Zn^{2+}$, and trivalent metal ions, such as $Fe^{3+}$, $Cr^{3+}$, $Y^{3+}$, and $Al^{3+}$. In an embodiment of the present invention, the polyvalent metal ions may be added in the form of salt, such as hydroxide or chloride, to the liquid composition. The polyvalent metal ions may also be dissociated ions. In an embodiment of the present invention, the polyvalent metal ion content (% by mass) is preferably 3% by mass or more and 90% by mass or less of the total mass of the liquid composition.

Specific examples of the organic acids include, but are not limited to, oxalic acid, poly(acrylic acid), formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidonecarboxylic acid, pyronecarboxylic acid, pyrrolecarboxylic acid, furancarboxylic acid, pyridinecarboxylic acid, coumaric acid, thiophenecarboxylic acid, nicotinic acid, oxysuccinic acid, and dioxysuccinic acid.

Specific examples of the cationic polymers include, but are not limited to, polyallylamine, dicyandiamide resin, polyethyleneimine, and polyacrylamide.

In an embodiment of the present invention, the organic acid content (% by mass) is preferably 3% by mass or more and 99% by mass or less of the total mass of the liquid composition.

The amount of reaction agent on an intermediate transfer member is preferably 0.1 $g/m^2$ or more and 10.0 $g/m^2$ or less, more preferably 0.2 $g/m^2$ or more and 2.0 $g/m^2$ or less. Less than 0.1 $g/m^2$ of the reaction agent causes insufficient precipitation and aggregation of an ink component, possibly resulting in coalescence of adjacent ink dots. More than 10.0 $g/m^2$ of the reaction agent results in an increased thickness of a liquid composition layer on an intermediate transfer member. Thus, ink droplets cannot easily come into contact with the intermediate transfer member and tend to float on the liquid composition, resulting in a deformed intermediate image.

Second Polymer Particles

In an embodiment of the present invention, the liquid composition contains second polymer particles that satisfy storage elastic modulus relationships represented by the following formula (1):

$$E1' \leq 0.1 \text{ MPa}, E2' \geq 1.0 \text{ MPa} \quad \text{Formula (1):}$$

wherein E1' denotes a storage elastic modulus at Ta, and E2' denotes a storage elastic modulus at ((Ta+Tb)*0.5), Ta denotes the temperature of the intermediate image before transfer in the transferring process, and Tb denotes the temperature of the recording medium before transfer in the transferring process.

E1' of more than 0.1 MPa may result in insufficient adhesion strength between an intermediate image and a recording medium and low transfer efficiency. E2' of less than 1.0 MPa may result in insufficient intermediate image strength and low transfer efficiency.

In the embodiments of the present invention described below, the storage elastic moduli were measured with a dynamic viscoelastic analyzer DVA-200 (manufactured by IT Keisoku Seigyo Co., Ltd.) in a shear deformation mode using a test specimen formed by heating second polymer particles to a temperature above the melting point or glass transition point of the second polymer particles.

The second polymer particles may be composed of a conventionally known compound, particularly at least one selected from resins having a melting point. The liquid composition can contain a plurality of types of second polymer particles. Specific examples of the conventionally known compound include, but are not limited to, polyolefin wax, such as polyethylene and polypropylene, paraffin wax, and carnauba wax. The second polymer particles can be composed of polyolefin wax or carnauba wax.

In an embodiment of the present invention, the second polymer particle content (% by mass) is preferably 1% by mass or more and 90% by mass or less of the total mass of the liquid composition. A second polymer particle content of less than 1% by mass results in an increased amount of liquid composition required to apply 0.5 $g/m^2$ or more and 5.0 $g/m^2$ or less of second polymer particles to an intermediate transfer member and an increased thickness of a liquid composition layer. This may result in deformation of an intermediate image and a high energy load required to dry the liquid composition. A second polymer particle content of more than 90% by mass results in an unstable dispersion state of second polymer particles in a liquid composition, which may result in low coating uniformity of the liquid composition, poor intermediate image quality, or low transferability.

The second polymer particles can be dispersed in a liquid composition. The second polymer particles can be dispersed by using an emulsifier or by oxidation treatment.

The second polymer particles can be nonionic polymer particles. The second polymer particles composed of ionic polymer particles may react with a reaction agent and at least partly aggregate. This may lower liquid composition uniformity on an intermediate transfer member, intermediate image quality, or transferability.

The second polymer particles preferably have an average particle size of 0.01 μm or more and 10 μm or less, more preferably 0.03 μm or more and 1 μm or less. An average particle size of less than 0.01 μm may result in unstable dispersion of second polymer particles in a liquid composition and low coating uniformity. An average particle size of more than 1 μm results in a great distance between second polymer particles applied to an intermediate transfer member, possibly resulting in in-plane uneven transferability. In the embodiments of the present invention, the average particle size of second polymer particles is measured by dynamic light scattering.

The second polymer particles preferably have a melting point equal to or lower than the temperature Ta of an intermediate image measured before transfer in the transferring process. The second polymer particles preferably have a melting point of 50° C. or more and 160° C. or less, more preferably 80° C. or more and 120° C. or less, in terms of the heat resistance of resulting images and process load.

Surfactant

In an embodiment of the present invention, the liquid composition may contain a surfactant. The surfactant may be composed of a conventionally known compound and can contain at least one selected from fluorinated surfactants and silicone surfactants. In an embodiment of the present invention, the fluorinated surfactants have a fluoroalkyl group, and the silicone surfactants have a dimethylsiloxane group. A plurality of surfactants may be used in combination.

Specific examples of the fluorinated surfactants include, but are not limited to, perfluoroalkylethylene oxide adducts F444 (manufactured by DIC Corporation) and Zonyl FSO-100 (manufactured by Sigma-Aldrich Corporation). Specific examples of the silicone surfactants include, but are not limited to, polyether-modified siloxane compounds BYK-348 and BYK-349 (manufactured by BYK-Chemie).

In an embodiment of the present invention, the total application amount of fluorinated surfactants and silicone surfactants is 0.1 $g/m^2$ or more and 1.0 $g/m^2$ or less. A total application amount of less than 0.1 $g/m^2$ may result in low wettability of an intermediate image on an intermediate transfer member and may result in deformation of the intermediate image when the fluidity of the liquid composition is increased, for example, by heating the intermediate transfer member. A total application amount of more than 1.0 $g/m^2$ may result in an increased thickness of a liquid composition layer on an intermediate transfer member. Thus, ink droplets cannot easily come into contact with the intermediate transfer member and tend to float on the liquid composition, resulting in a deformed intermediate image.

The surfactant content (% by mass) is preferably 0.1% by mass or more and 50% by mass or less of the total mass of the liquid composition.

Aqueous Medium

In an embodiment of the present invention, the liquid composition may contain an aqueous medium, such as water or a mixed solvent of water and a water-soluble organic solvent. The water-soluble organic solvent content (% by mass) is preferably 3.0% by mass or more and 50.0% by mass or less of the total mass of the ink or liquid composition. The water-soluble organic solvent may be a common water-soluble organic solvent. Examples of such a water-soluble organic solvent include, but are not limited to, alcohols, glycols, alkylene glycols in which the number of carbon atoms of the alkylene group ranges from 2 to 6, polyethylene glycol), nitrogen-containing compounds, and sulfur-containing compounds. These water-soluble organic solvents may be used alone or in combination as required. Water can be deionized water (ion-exchanged water). The water content (% by mass) is preferably 50.0% by mass or more and 95.0% by mass or less of the total mass of the ink or liquid composition.

Other Components

In addition to the components described above, if necessary, a liquid composition according to an embodiment of the present invention may further contain a water-soluble organic compound that is solid at normal temperature, for example, a polyhydric alcohol, such as trimethylolpropane or trimethylolethane, urea, or a urea derivative, such as ethylene urea. If necessary, a liquid composition according to an embodiment of the present invention may further contain an additive agent, such as a pH adjuster, an anticorrosive, a preservative, a fungicide, an antioxidant, a reducing inhibitor, an evaporation promoter, a chelator, a lubricant, inorganic particles, and/or a resin. The amount of these materials (% by mass) is preferably 1% by mass or more and 30% by mass or less of the total mass of the liquid composition.

[Liquid Composition Drying Process]

In an embodiment of the present invention, a liquid composition drying process for drying a liquid composition on an intermediate transfer member may be performed after the liquid composition applying process and before the intermediate image forming process. A decrease in the thickness of a liquid composition layer in the liquid composition drying process reduces the likelihood of degradation in intermediate image quality caused by movement of ink droplets applied in the intermediate image forming process on the liquid composition layer. Thus, the liquid composition on the intermediate transfer member can be dried to remove excessive liquid in the liquid composition drying process. The liquid can be removed by a heating method, a low-humidity air blow method, a depressurizing method, a natural drying method, or a combination thereof. Alternatively, a liquid composition not containing an excessive liquid component may be applied to an intermediate transfer member.

[Intermediate Image Forming Process]

In an embodiment of the present invention, an ink is applied to an intermediate transfer member in the intermediate image forming process. The ink can be applied to the intermediate transfer member with an ink jet system. In particular, the ink can be ejected from an ejection port of a recording head by the application of thermal energy.

The ink jet system includes a recording head, such as a line head or serial head. An ink jet head of a line head type has ink ejection ports arranged in a direction orthogonal to the rotation direction of an intermediate transfer member (in the axial direction in the case of a drum-shaped intermediate transfer member). A serial head is scanned for recording in a direction orthogonal to the rotation direction of an intermediate transfer member.

In an embodiment of the present invention, an intermediate image formed in the intermediate image forming process can satisfy storage elastic modulus relationships represented by the following formula (2):

$$E3' \leq 0.1\ \text{MPa},\ E4' \geq 1.0\ \text{MPa} \qquad \text{Formula (2):}$$

wherein E3' denotes a storage elastic modulus at Ta, and E4' denotes a storage elastic modulus at ((Ta+Tb)*0.5), Ta denotes the temperature of the intermediate image before transfer in the transferring process, and Tb denotes the temperature of the recording medium before transfer in the transferring process.

<Ink>

Coloring Material

In an embodiment of the present invention, the ink contains a coloring material. The coloring material may be a pigment or dye. The pigment or dye may be a conventionally known pigment or dye. In an embodiment of the present invention, a pigment can be used to improve the water fastness of images. The coloring material content (% by mass) preferably ranges from 0.5% by mass or more and 15.0% by mass or less, more preferably 1.0% by mass or more and 10.0% by mass or less, of the total mass of the ink.

In an embodiment of the present invention, when a pigment is used as a coloring material, the pigment may be of a resin dispersion type produced by using a resin as a dispersant (a resin-dispersed pigment containing a resin dispersant, a microcapsule pigment coated with a resin, or a resin-bonded pigment in which the pigment particle is chemically bonded to a resin via an organic group) or of a self-dispersion type having a hydrophilic group on the surface of the pigment particles (a self-dispersing pigment). As a matter of course, pigments of different dispersion types may also be used in combination. More specifically, the pigment can be carbon black or an organic pigment. These pigments may be used alone or in combination. When a pigment of a resin dispersion type is used in the ink, a resin is used as a dispersant. The resin used as a dispersant can have a hydrophilic moiety and a hydrophobic moiety. More specifically, the resin may be an acrylic resin produced by polymerization of a monomer having a carboxy group, such as acrylic acid or methacrylic acid, or a urethane resin produced from a diol having an anionic group, such as dimethylolpropionic acid. The resin used as a dispersant preferably has an acid value of 50 mgKOH/g or more and 550 mgKOH/g or less. The resin used as a dispersant preferably has a polystyrene equivalent weight-average molecular weight (Mw) of 1,000 or more and 50,000 or less as determined by gel permeation chromatography (GPC). The resin dispersant content (% by mass) of the ink is preferably 0.1% by mass or more and 10.0% by mass or less, more preferably 0.2% by mass or more and 4.0% by mass or less, of the total mass of the ink. The mass ratio of the resin dispersant content (% by mass) to the pigment content (% by mass) is preferably 0.1 or more and 3.0 or less.

First Polymer Particles

In an embodiment of the present invention, the ink contains first polymer particles. The first polymer particles improve not only the strength and transfer efficiency of an intermediate image but also the scratch resistance and water fastness of final images. Furthermore, in the intermediate image forming process, the first polymer particles are effective in suppressing deformation of an intermediate image resulting from movement of ink droplets from their predetermined positions.

The term "first polymer particles", as used herein, refers to a polymer dispersed in a solvent in a state in which the polymer has a particle size. In an embodiment of the present invention, the polymer particles preferably have a 50% cumulative volume-average particle size ($D_{50}$) of 10 nm or more and 1,000 nm or less, more preferably 50 nm or more and 500 nm or less. In the embodiments of the present invention, $D_{50}$ of polymer particles is determined by the following method. $D_{50}$ of polymer particles is measured in a polymer particle dispersion diluted 50-fold (on a volume basis) with pure water using UPA-EX150 (manufactured by Nikkiso Co., Ltd.) under the measurement conditions of SetZero: 30 s, the number of measurements: 3, measurement time: 180 seconds, and refractive index: 1.5.

The polymer particles preferably have a polystyrene equivalent weight-average molecular weight of 1,000 or more and 2,000,000 or less as determined by gel permeation chromatography (GPC).

The polymer particles preferably have a minimum film-forming temperature of 20° C. or more and 100° C. or less. In the embodiments of the present invention, the minimum film-forming temperature of polymer particles is measured according to JIS K 6828-2 "Determination of minimum film-forming temperature".

In an embodiment of the present invention, the ink may contain any polymer particles that satisfy the definition of polymer particles described above. Monomers for use in the polymer particles may be any polymerizable monomers for use in emulsion polymerization methods, suspension polymerization methods, and dispersion polymerization methods. Depending on the type of monomer, the polymer particles may be acrylic, vinyl acetate, ester, ethylene, urethane, synthetic rubber, vinyl chloride, vinylidene chloride, or olefin polymer particles. Among these, the polymer particles may be acrylic polymer particles or urethane polymer particles.

Specific examples of monomers for use in acrylic polymer particles include, but are not limited to, α,β-unsaturated carboxylic acids, such as (meth)acrylic acid, maleic acid, crotonic acid, angelic acid, itaconic acid, and fumaric acid, and salts thereof; α,β-unsaturated carboxylic acid ester compounds, such as ethyl(meth)acrylate, methyl(meth)acrylate, butyl(meth)acrylate, methoxyethyl(meth)acrylate, ethoxyethyl(meth)acrylate, diethylene glycol(meth)acrylate, triethylene glycol(meth)acrylate, tetraethylene glycol(meth)acrylate, polyethylene glycol)(meth)acrylate, methoxydiethylene glycol(meth)acrylate, methoxytriethylene glycol (meth)acrylate, methoxytetraethylene glycol(meth)acrylate, methoxypoly(ethylene glycol)(meth)acrylate, cyclohexyl (meth)acrylate, isobornyl(meth)acrylate, N,N-dimethylaminopropyl(meth)acrylate, monobutyl maleate, and dimethyl itaconate; α,β-unsaturated carboxylic acid alkylamide compounds, such as (meth)acrylamide, dimethyl(meth)acrylamide, N,N-dimethylethyl(meth)acrylamide, N,N-dimethylpropyl(meth)acrylamide, isopropyl(meth)acrylamide, diethyl(meth)acrylamide, (meth)acryloylmorpholine, maleic acid monoamide, and crotonic acid methylamide; α,β-ethylenically unsaturated compounds having an aryl group, such as styrene, α-methylstyrene, vinyl phenyl acetate, benzyl(meth)acrylate, and 2-phenoxyethyl(meth)acrylate; and polyfunctional alcohol ester compounds, such as ethylene glycol diacrylate and poly(propylene glycol)dimethacrylate. The polymer particles may be composed of a homopolymer or copolymer of these monomers. When the first polymer particles are composed of a copolymer, the copolymer may be a random copolymer or a block copolymer. In particular, the first polymer particles can be composed of a hydrophilic monomer and a hydrophobic monomer. Examples of the hydrophilic monomer include, but are not limited to, α,β-unsaturated carboxylic acids and salts thereof. Examples of the hydrophobic monomer include, but are not limited to, α,β-unsaturated carboxylic acid ester compounds and α,β-ethylenically unsaturated compounds having an aryl group.

Urethane polymer particles are synthesized by a reaction between a polyisocyanate and a polyol compound. Polyisocyanates have two or more isocyanate groups. Polyol compounds have two or more hydroxyl groups. In an embodiment of the present invention, any urethane polymer particles synthesized by a reaction between a known polyisocyanate compound and a known polyol compound may be used, provided that the urethane polymer particles satisfy the conditions for the polymer particles described above.

The first polymer particles may have a monolayer structure or a multilayer structure, such as a core-shell structure. In an embodiment of the present invention, the first polymer particles can have a multilayer structure. In particular, the first polymer particles can have a core-shell structure. In the first polymer particles having a core-shell structure, the core and the shell can have different functions. Polymer particles having a core-shell structure can advantageously provide more functions for the ink than polymer particles having a monolayer structure.

In an embodiment of the present invention, the first polymer particle content (% by mass) of the ink is preferably 0.5% by mass or more and 40.0% by mass or less, more preferably 1.0% by mass or more and 30.0% by mass or less, of the total mass of the ink.

In an embodiment of the present invention, the ratio of the amount ($g/m^2$) of second polymer particles to the amount ($g/m^2$) of first polymer particles applied to an intermediate transfer member is preferably 0.15 or more and 2.80 or less. When this ratio is less than 0.15, the transfer efficiency improving effect due to the storage elastic modulus of the second polymer particles may be insufficient. When the ratio is more than 2.80, an intermediate image may be deformed in the intermediate image forming process, thus resulting in poor image quality.

Aqueous Medium

An ink according to an embodiment of the present invention may contain an aqueous medium, such as water or a mixed solvent of water and a water-soluble organic solvent.

The water-soluble organic solvent content (% by mass) is preferably 3.0% by mass or more and 50.0% by mass or less of the total mass of the ink. The water-soluble organic solvent may be a common water-soluble organic solvent. Examples of such a water-soluble organic solvent include, but are not limited to, alcohols, glycols, alkylene glycols in which the number of carbon atoms of the alkylene group ranges from 2 to 6, polyethylene glycol), nitrogen-containing compounds, and sulfur-containing compounds. These water-soluble organic solvents may be used alone or in combination as required. Water can be deionized water (ion-exchanged water). The water content (% by mass) is preferably 50.0% by mass or more and 95.0% by mass or less of the total mass of the ink.

Other Components

In addition to the components described above, if necessary, an ink according to an embodiment of the present invention may further contain a water-soluble organic compound that is solid at normal temperature, for example, a polyhydric alcohol, such as trimethylolpropane or trimethylolethane, urea, or a urea derivative, such as ethylene urea. If necessary, an ink according to an embodiment of the present invention may further contain an additive agent, such as a surfactant, a pH adjuster, an anticorrosive, a preservative, a fungicide, an antioxidant, a reducing inhibitor, an evaporation promoter, a chelator, and/or a resin.

[Liquid Removing Process]

In an embodiment of the present invention, a liquid removing process for removing liquid from an intermediate image on an intermediate transfer member may be performed after the intermediate image forming process and before the transferring process. When an intermediate image contains excessive liquid, the excessive liquid may overflow in the transferring process, thus resulting in poor image quality. Thus, excessive liquid may be removed from an intermediate image in the liquid removing process. The liquid can be removed by a heating method, a low-humidity air blow method, a depressurizing method, a natural drying method, or a combination thereof.

[Transferring Process]

In an embodiment of the present invention, in the transferring process, an intermediate image on an intermediate transfer member is brought into close contact with a recording medium and is then separated from the intermediate transfer member, thereby recording an image on the recording medium.

An intermediate image can be transferred to a recording medium by pressing an intermediate transfer member and the recording medium with a pressure roller. The pressurization can improve transfer efficiency. The pressurization may be performed in multiple steps.

As described above, with the growing demand for high-speed recording in recent years, high transfer efficiency is required even when the contact-separation time is short. In an embodiment of the present invention, the contact-separation time is preferably 1 millisecond or more and 100 milliseconds or less. For example, when the contact-separation time is 10 milliseconds, and the movement distance during the contact is 10 mm, the conveyance speed of an intermediate transfer member in the transferring process is as high as 1.0 m/s.

A contact-separation time of less than 1 millisecond may result in insufficient contact between an intermediate image and a recording medium and low transfer efficiency. A contact-separation time of more than 100 milliseconds may result in low recording efficiency due to a low conveyance speed or an increased apparatus size due to a long conveyance distance.

After an intermediate transfer member and a recording medium are pressed with a pressure roller with an intermediate image interposed therebetween, the intermediate transfer member and the recording medium may be cooled during conveyance and then separated from each other. However, such a mechanism increases the contact-separation time.

In the transferring process, an intermediate image can be heated before contact with a recording medium. An intermediate image can be heated by heating an intermediate transfer member to a predetermined temperature or by installing a heater. The temperature of an intermediate transfer member before contact with a recording medium can depend on the type of second polymer particles contained in a liquid composition and can be controlled such that an intermediate image has a temperature at which the storage elastic modulus of the second polymer particles in the liquid composition is 0.1 MPa or less.

In the transferring process, a recording medium can be heated or cooled to a predetermined temperature before contact with an intermediate image. A recording medium can be heated or cooled by heating or cooling a container or conveyor for the recording medium to a predetermined temperature or by installing a heater or chiller. The temperature of a recording medium before contact with an intermediate image formed on an intermediate transfer member can depend on the type of second polymer particles contained in a liquid composition and can be controlled such that the second polymer particles have a storage elastic modulus of 1.0 MPa or more at a temperature of ((Ta+Tb)*0.5), which is calculated from the temperature (Ta) of the intermediate image and the temperature (Tb) of the recording medium measured before the recording medium comes into contact with the intermediate image formed on the intermediate transfer member.

The temperature Ta is preferably 10° C. or more higher than the melting point of the second polymer particles. The temperature Tb is preferably 50° C. or more lower than the melting point of the second polymer particles.

A difference in temperature between a transfer roller and a recording medium in the transferring process is preferably 10° C. or less, more preferably 5° C. or less.

When the second polymer particles have storage elastic moduli represented by the formula (1), an intermediate image on an intermediate transfer member can be transferred to a recording medium with high transfer efficiency even when the contact-separation time is short or even when a recording media having a rough surface is used.

When the second polymer particles have storage elastic moduli represented by the formula (1), a liquid composition on a non-image area on which no intermediate image is formed can also be transferred to a recording medium with high transfer efficiency. This can decrease the amount of intermediate image and liquid composition that are not transferred to a recording medium and remain on an intermediate transfer member and thereby decrease cleaning load when the intermediate transfer member is repeatedly used for recording.

<Recording Medium>

In an embodiment of the present invention, the recording medium is not limited to general printing paper (cast-coated paper, art coated paper, matt coated paper, embossed paper, uncoated paper, high-quality paper, plain paper, and recycled paper) and may be cloth, a plastic, or a film. Recording media for use in an image-recording method according to an embodiment of the present invention may be cut into desired sizes in advance. Alternatively, a rolled sheet may be cut into desired sizes after image recording.

[Fixing Process]

In an embodiment of the present invention, the transferring process may be followed by a fixing process, in which a recording medium to which an intermediate image is transferred is pressed with a fixing roller. The fixing roller can be heated. Pressurization with a heated fixing roller can improve image fastness. The smoothness and gloss of not only an image area but also a non-image area, which includes a liquid composition transferred from an intermediate transfer member to a recording medium, can be controlled by adjusting the pressure, temperature, and surface profile of the fixing roller.

More specifically, high-gloss images may be recorded by heating the fixing roller to a temperature above the melting point of second polymer particles disposed on an image area and a non-image area of a recording medium and thereby improving the smoothness of the images. Images having gloss close to the gloss of a recording medium to which the images are not yet transferred may be recorded by heating the fixing roller to a high temperature, increasing the fluidity of the second polymer particles, and allowing the second polymer particles to permeate into the recording medium.

[Preparation of Polymer Particle Dispersion]

<Preparation of Polymer Particle Dispersion P1>

A mixture of 18 parts of ethyl methacrylate, 2 parts of 2,2'-azobis-(2-methylbutyronitrile), and 2 parts of n-hexadecane was stirred for 0.5 hours. The mixture was added dropwise to 78 parts of 6% aqueous solution of an emulsifier NIKKOL BC20 (manufactured by Nikko Chemicals Co., Ltd.) and was stirred for 1.0 hours. Ultrasonic waves were then applied to the mixture with an ultrasonic generator for 5.0 hours. A polymerization reaction was performed in a nitrogen atmosphere at 85° C. for 3 hours. The product was cooled to room temperature and was filtered, thus yielding a polymer particle dispersion P1 having a polymer content of 20.0% by mass. The polymer particles of P1 had a minimum film-forming temperature of 110° C. and an average particle size of 0.2 μm.

<Preparation of Polymer Particle Dispersions P2 to P7>

Polymer particle dispersions P2 to P7 listed in Table 1 were prepared. P4 is a polyethylene particle dispersion having an average particle size and a melting point listed in Table 1. Table 1 lists the polymer content of each dispersion and the average particle size, melting point, and ionicity of polymer particles of each dispersion.

TABLE 1

Type and physical properties of polymer particles

| Polymer particle dispersion No. | Product name | Manufacturer | Type | Resin content (mass %) | Average particle size (μm) | Melting point (° C.) | Ionicity |
|---|---|---|---|---|---|---|---|
| P1 | — | — | Acrylic resin | 20 | 0.2 | None | Nonionic |
| P2 | HORDAMER PE 03 | BYK-Chemie | Polyolefin wax | 40 | 0.2 | 95 | Nonionic |
| P3 | HORDAMER PE 02 | BYK-Chemie | Polyolefin wax | 40 | 0.2 | 95 | Anionic |
| P4 | — | — | Polyolefin wax | 40 | 4.0 | 95 | Nonionic |
| P5 | ChemipearlW400 | Mitsui Chemicals | Polyolefin wax | 40 | 4.0 | 110 | Anionic |
| P6 | AQUACER-2650 | BYK-Chemie | Carnauba wax | 30 | 0.2 | 85 | Nonionic |
| P7 | EMUSTAR-0136 | Nippon Seiro | Paraffin wax | 40 | 0.3 | 61 | Nonionic |

[Cleaning Process]

In an embodiment of the present invention, the transferring process may be followed by a cleaning process for cleaning a surface of an intermediate transfer member. An intermediate transfer member may be cleaned by any known method. Specific examples of the cleaning method include, but are not limited to, a method for spraying an intermediate transfer member with a cleaning liquid, a method for wiping an intermediate transfer member with a wet molleton roller, a method for bringing an intermediate transfer member into contact with a cleaning liquid surface, a method for wiping residual substances off an intermediate transfer member with a wiper blade, a method for applying energy to an intermediate transfer member, and combinations thereof.

Exemplary Embodiments

The present invention will be further described with the following exemplary embodiments and comparative examples. However, the present invention should not be limited to these exemplary embodiments. Unless otherwise specified, "part" in the exemplary embodiments is on a mass basis.

[Preparation of Ink]

<Preparation of Pigment Dispersion>

10 parts of carbon black (product name: Monarch 1100, manufactured by Cabot Corporation), 15 parts of an aqueous resin solution (an aqueous solution of a styrene-ethyl acrylate-acrylic acid copolymer (acid value: 150, weight-average molecular weight: 8,000, resin content: 20.0% by mass) neutralized with aqueous potassium hydroxide), and 75 parts of pure water were dispersed under water cooling for 5 hours with 200 parts of 0.3-mm zirconia beads in a batch-type vertical sand mill (manufactured by AIMEX Co., Ltd.). The dispersion liquid was centrifuged to remove coarse particles. The resulting pigment dispersion had a pigment content of 10.0% by mass.

<Preparation of Ink>

The polymer particle dispersion P1, the pigment dispersion, and the components listed in Table 2 were mixed. The mixture was well dispersed and was passed through a microfilter having a pore size of 3.0 μm under pressure to prepare an ink. "AE100" in the table denotes a surfactant Acetylenol E100 manufactured by Kawaken Fine Chemicals Co., Ltd.

TABLE 2

| Ink preparation conditions | | | | | (Unit: mass %) |
|---|---|---|---|---|---|
| Ink No. | Pigment dispersion | Polymer particle dispersion P1 | Glycerin | AE100 | Ion-exchanged water |
| Ink 1 | 20.0 | 50.0 | 10.0 | 1.0 | 19.0 |
| Ink 2 | 20.0 | 10.5 | 10.0 | 1.0 | 59.0 |
| Ink 3 | 20.0 | 5.0 | 10.0 | 1.0 | 64.0 |
| Ink 4 | 20.0 | 60.0 | 10.0 | 1.0 | 9.0 |
| Ink 5 | 20.0 | 69.0 | 10.0 | 1.0 | — |
| Ink 6 | 20.0 | — | 10.0 | 1.0 | 69.0 |

[Preparation of Liquid Composition]

The components listed in Table 3 were well dispersed to prepare each liquid composition. In the table, "PAA" denotes polyallylamine manufactured by Nitto Boseki Co., Ltd. (PAA-01, solid content: 15% by mass), "NMO" denotes N-methylmorpholine N-oxide, "F444" is a fluorinated surfactant manufactured by DIC Corporation, and "BYK349" is a silicone surfactant manufactured by BYK-Chemie.

TABLE 3

| Liquid composition preparation conditions | | | | | | | | |
|---|---|---|---|---|---|---|---|---|
| | Reaction agent | | NMO | Polymer particle dispersion | | Surfactant | | Ion-exchanged water |
| Liquid composition No. | Type | Content (parts by mass) | Content (parts by mass) | Type | Content (parts by mass) | Type | Content (parts by mass) | Content (parts by mass) |
| Liquid composition 1 | Levulinic acid | 10.0 | 2.0 | P2 | 47.0 | F444 | 7.0 | 34.0 |
| Liquid composition 2 | Levulinic acid | 10.0 | 2.0 | P2 | 28.2 | F444 | 7.0 | 34.0 |
| Liquid composition 3 | Levulinic acid | 10.0 | 2.0 | P2 | 188.0 | F444 | 7.0 | 34.0 |
| Liquid composition 4 | Levulinic acid | 10.0 | 2.0 | P2 | 460.0 | F444 | 7.0 | 34.0 |
| Liquid composition 5 | Levulinic acid | 10.0 | 2.0 | P2 | 564.0 | F444 | 7.0 | 34.0 |
| Liquid composition 6 | Levulinic acid | 10.0 | 2.0 | P3 | 47.0 | F444 | 7.0 | 34.0 |
| Liquid composition 7 | Levulinic acid | 10.0 | 2.0 | P4 | 47.0 | F444 | 7.0 | 34.0 |
| Liquid composition 8 | Calcium nitrate | 10.0 | — | P2 | 47.0 | F444 | 7.0 | 34.0 |
| Liquid composition 9 | PAA | 66.7 | — | P2 | 47.0 | F444 | 7.0 | 34.0 |
| Liquid composition 10 | Levulinic acid | 10.0 | 2.0 | P2 | 47.0 | F444 | 1.6 | 34.0 |
| Liquid composition 11 | Levulinic acid | 10.0 | 2.0 | P2 | 47.0 | BYK349 | 7.0 | 34.0 |
| Liquid composition 12 | Levulinic acid | 10.0 | 2.0 | P2 | 47.0 | AE100 | 7.0 | 34.0 |
| Liquid composition 13 | — | — | — | P2 | 47.0 | F444 | 7.0 | 34.0 |
| Liquid composition 14 | Levulinic acid | 10.0 | 2.0 | P5 | 47.0 | F444 | 7.0 | 34.0 |
| Liquid composition 15 | Levulinic acid | 10.0 | 2.0 | P6 | 62.7 | F444 | 7.0 | 34.0 |
| Liquid composition 16 | Levulinic acid | 10.0 | 2.0 | P7 | 47.0 | F444 | 7.0 | 34.0 |
| Liquid composition 17 | Levulinic acid | 10.0 | 2.0 | P1 | 94.0 | F444 | 7.0 | 34.0 |

[Manufacture of Intermediate Transfer Member]

A cylindrical drum in which a silicone rubber was disposed on an aluminum alloy was used as a supporting member of an intermediate transfer member. A siloxane compound surface layer formed of a hydrolyzable organosilicon compound was formed on a surface of the supporting member by the following method. First, glycidoxypropyltriethoxysilane and methyltriethoxysilane were mixed at a mole ratio of 1:1 and were heated under reflux in a water medium together with a hydrochloric acid catalyst for 24 hours or more, yielding a hydrolyzable condensate solution. The hydrolyzable condensate solution was then diluted to 10% to 20% by mass with methyl isobutyl ketone. A photo-cationic polymerization initiator SP150 (manufactured by Adeka Corporation) was added to the hydrolyzable condensate solution, yielding a coating solution. The photo-cationic polymerization initiator SP150 constituted 5% by mass of the solid content of the hydrolyzable condensate solution. The coating solution was applied to a plasma-treated surface of the supporting member. An intermediate transfer member was completed by surface exposure using a UV lamp and heating at 150° C. for 2 hours. The thickness of the surface layer of the intermediate transfer member was approximately 0.5 μm.

[Image Recording and Evaluation Results]

<Quality Evaluation of Intermediate Image>

An ink cartridge filled with the ink and the liquid composition as listed in Tables 4 and 5 was placed in an image-recording apparatus illustrated in FIGURE. First, the liquid composition was applied to an intermediate transfer member with an application roller. The application amount of polymer particles is listed in Tables 4 and 5 (for example, in the case of Exemplary Embodiment 1, the polymer particle dispersion (polymer particle content: 40% by mass) constituted 47.0% by mass of a liquid composition 1, and the application amount of the liquid composition is 2.7 g/m$^2$).

25° C. air was then blown over the intermediate transfer member for 60 seconds to evaporate at least part of water in the liquid composition. The ink was applied to the intermediate transfer member with an inkjet type recording head, thus forming an intermediate image. The application amount of polymer particles is listed in Tables 4 and 5. The ejection pattern for the intermediate image was a single-dot pattern containing 50 single-dots, which were separated from each other, in a 1 cm*1 cm area, or a 100% or 300% solid pattern in which a solid image having a recording duty of 100% or 300% was formed in a 1 cm*1 cm area. In the image-recording apparatus, the recording duty of 100% refers to the conditions that a single ink droplet (4 ng) is applied to a 1/1200-inch*1/1200-inch unit area at a resolution of 1200 dpi*1200 dpi.

The quality of the intermediate image was evaluated by the difference in shape between the ejection pattern and the intermediate image. The evaluation criteria were described below. Of the following evaluation criteria, A and B represent acceptable levels, and C represents an unacceptable level. Table 6 shows the results.

A: No problem in visual inspection and optical microscope observation.

B: No problem in visual inspection, but a slight difference in shape in optical microscope observation.

C: A noticeable difference in shape in visual inspection.

<Evaluation of Transfer Efficiency>

25° C. air was then blown over the intermediate image for 60 seconds with a liquid removing means. The temperature of the intermediate image was adjusted to be Ta listed in Tables 4 and 5 for at least one second by heating the intermediate transfer member with a heating mechanism. The intermediate transfer member on which the intermediate image was formed and a recording medium having a temperature of Tb listed in Tables 4 and 5 were then conveyed at a speed of 2.0 m/s. The intermediate image was transferred to the recording medium with a 25° C. pressure roller at a pressure of 1.5 MPa. The intermediate transfer member was separated from the recording medium immediately after passing the pressure roller. The pressing time with the pressure roller corresponds to the contact-separation time. Because the pressing distance with the pressure roller is 20 mm, the contact-separation time is 10 milliseconds. After these processes were performed 25 times, the percentage of a residual intermediate image on an intermediate transfer member, that is, the transfer residual ratio (%) was determined. More specifically, the transfer residual ratio was determined by removing an intermediate transfer member from a supporting member, capturing a surface image of the intermediate transfer member, and calculating the ratio of the area of a residual intermediate image on the intermediate transfer member to the area of a recorded intermediate image. The transfer efficiency was evaluated from the transfer residual ratio. The evaluation criteria were described below. Of the following evaluation criteria, A and B represent acceptable levels, and C and D represent unacceptable levels. Table 6 shows the results.

A: The transfer residual ratio was less than 3%.

B: The transfer residual ratio was 3% or more and less than 5%.

C: The transfer residual ratio was 5% or more and less than 10%.

D: The transfer residual ratio was 10% or more.

<Evaluation of Final Image Quality>

The quality of final images was evaluated by the difference in shape between a mirror image of an ejection pattern and a final image. The evaluation criteria were described below. Of the following evaluation criteria, A and B represent acceptable levels, and C represents an unacceptable level. Table 6 shows the results.

A: No significant difference in shape was visually observed and with an optical microscope.

B: Although no significant difference in shape was visually observed, a slight difference in shape was observed with an optical microscope.

C: A significant difference in shape was also visually observed.

TABLE 4

| Image recording conditions | | | | | | | | | | | | |
|---|---|---|---|---|---|---|---|---|---|---|---|---|
| | Liquid composition | | | | | Ink | | Intermediate image | Conditions in transferring step | | | |
| | | Polymer particles | | | Application | | Application amount of | Polymer particle | Type of | Temperature (° C.) | | |
| Embodiment | | Storage elastic modulus (MPa) | | Application amount | amount of surfactant | | polymer particles | application amount | recording medium for | | | (Ta + Tb) × |
| No. | Type | E1' | E2' | (g/m$^2$) | (g/m$^2$) | Type | (g/m$^2$) | ratio | transfer | Ta | Tb | 0.5 |
| Exemplary embodiment 1 | Liquid composition 1 | $<5.0 \times 10^{-2}$ | 4.0 | 0.51 | 0.19 | Ink 1 | 0.89 | 0.57 | Recording medium 1 | 110 | 25 | 67.5 |
| Exemplary embodiment 2 | Liquid composition 1 | $<5.0 \times 10^{-2}$ | 4.0 | 0.51 | 0.19 | Ink 1 | 0.89 | 0.57 | Recording medium 2 | 110 | 25 | 67.5 |
| Exemplary embodiment 3 | Liquid composition 1 | $<5.0 \times 10^{-2}$ | 2.0 | 0.51 | 0.19 | Ink 1 | 0.89 | 0.57 | Recording medium 1 | 130 | 25 | 77.5 |
| Exemplary embodiment 4 | Liquid composition 1 | $8.0 \times 10^{-2}$ | 7.0 | 0.51 | 0.19 | Ink 1 | 0.89 | 0.57 | Recording medium 1 | 100 | 25 | 62.5 |
| Exemplary embodiment 5 | Liquid composition 1 | $<5.0 \times 10^{-2}$ | 8.0 | 0.51 | 0.19 | Ink 1 | 0.89 | 0.57 | Recording medium 1 | 110 | 5 | 57.5 |
| Exemplary embodiment 6 | Liquid composition 3 | $<5.0 \times 10^{-2}$ | 4.0 | 2.00 | 0.19 | Ink 1 | 0.89 | 2.27 | Recording medium 1 | 110 | 25 | 67.5 |
| Exemplary embodiment 7 | Liquid composition 4 | $<5.0 \times 10^{-2}$ | 4.0 | 4.97 | 0.19 | Ink 1 | 0.89 | 5.56 | Recording medium 1 | 110 | 25 | 67.5 |
| Exemplary embodiment 8 | Liquid composition 6 | $<5.0 \times 10^{-2}$ | 4.0 | 0.51 | 0.19 | Ink 1 | 0.89 | 0.57 | Recording medium 1 | 110 | 25 | 67.5 |
| Exemplary embodiment 9 | Liquid composition 7 | $<5.0 \times 10^{-2}$ | 4.0 | 0.51 | 0.19 | Ink 1 | 0.89 | 0.57 | Recording medium 1 | 110 | 25 | 67.5 |
| Exemplary embodiment 10 | Liquid composition 8 | $<5.0 \times 10^{-2}$ | 4.0 | 0.51 | 0.19 | Ink 1 | 0.89 | 0.57 | Recording medium 1 | 110 | 25 | 67.5 |
| Exemplary embodiment 11 | Liquid composition 9 | $<5.0 \times 10^{-2}$ | 4.0 | 0.51 | 0.19 | Ink 1 | 0.89 | 0.57 | Recording medium 1 | 110 | 25 | 67.5 |
| Exemplary embodiment 12 | Liquid composition 10 | $<5.0 \times 10^{-2}$ | 4.0 | 0.51 | 0.04 | Ink 1 | 0.89 | 0.57 | Recording medium 1 | 110 | 25 | 67.5 |
| Exemplary embodiment 13 | Liquid composition 11 | $<5.0 \times 10^{-2}$ | 4.0 | 0.51 | 0.19 | Ink 1 | 0.89 | 0.57 | Recording medium 1 | 110 | 25 | 67.5 |
| Exemplary embodiment 14 | Liquid composition 12 | $<5.0 \times 10^{-2}$ | 4.0 | 0.51 | 0.19 | Ink 1 | 0.89 | 0.57 | Recording medium 1 | 110 | 25 | 67.5 |
| Exemplary embodiment 15 | Liquid composition 1 | $<5.0 \times 10^{-2}$ | 4.0 | 0.51 | 0.19 | Ink 2 | 0.19 | 2.70 | Recording medium 1 | 110 | 25 | 67.5 |

TABLE 4-continued

| Image recording conditions | | | | | | | | | | | | |
|---|---|---|---|---|---|---|---|---|---|---|---|---|
| | Liquid composition | | | | | Ink | | Intermediate image | Conditions in transferring step | | | |
| | | Polymer particles | | | Application | | Application amount of | Polymer particle | | Temperature (° C.) | | |
| Embodiment | | Storage elastic modulus (MPa) | | Application amount | amount of surfactant | | polymer particles | application amount | Type of recording medium for | | | (Ta + Tb) × |
| No. | Type | E1' | E2' | (g/m$^2$) | (g/m$^2$) | Type | (g/m$^2$) | ratio | transfer | Ta | Tb | 0.5 |
| Exemplary embodiment 16 | Liquid composition 1 | $<5.0 \times 10^{-2}$ | 4.0 | 0.51 | 0.19 | Ink 3 | 0.09 | 5.69 | Recording medium 1 | 110 | 25 | 67.5 |
| Exemplary embodiment 17 | Liquid composition 1 | $<5.0 \times 10^{-2}$ | 4.0 | 0.51 | 0.19 | Ink 4 | 1.07 | 0.47 | Recording medium 1 | 110 | 25 | 67.5 |
| Exemplary embodiment 18 | Liquid composition 1 | $<5.0 \times 10^{-2}$ | 4.0 | 0.51 | 0.19 | Ink 5 | 1.23 | 0.41 | Recording medium 1 | 110 | 25 | 67.5 |
| Exemplary embodiment 19 | Liquid composition 14 | $<5.0 \times 10^{-2}$ | 4.0 | 0.51 | 0.19 | Ink 1 | 2.68 | 0.57 | Recording medium 1 | 140 | 25 | 82.5 |
| Exemplary embodiment 20 | Liquid composition 14 | $<5.0 \times 10^{-2}$ | 4.0 | 0.51 | 0.19 | Ink 1 | 2.68 | 0.57 | Recording medium 2 | 140 | 25 | 82.5 |
| Exemplary embodiment 21 | Liquid composition 15 | $<5.0 \times 10^{-2}$ | 9.0 | 0.51 | 0.19 | Ink 1 | 2.68 | 0.57 | Recording medium 1 | 100 | 25 | 62.5 |
| Exemplary embodiment 22 | Liquid composition 15 | $<5.0 \times 10^{-2}$ | 9.0 | 0.51 | 0.19 | Ink 1 | 2.68 | 0.57 | Recording medium 2 | 100 | 25 | 62.5 |
| Exemplary embodiment 23 | Liquid composition 1 | $<5.0 \times 10^{-2}$ | 4.0 | 0.51 | 0.19 | Ink 1 | 2.68 | 0.19 | Recording medium 1 | 110 | 25 | 67.5 |
| Exemplary embodiment 24 | Liquid composition 1 | $<5.0 \times 10^{-2}$ | 4.0 | 0.51 | 0.19 | Ink 1 | 2.68 | 0.19 | Recording medium 2 | 110 | 25 | 67.5 |
| Exemplary embodiment 25 | Liquid composition 1 | $<5.0 \times 10^{-2}$ | 2.0 | 0.51 | 0.19 | Ink 1 | 2.68 | 0.19 | Recording medium 1 | 130 | 25 | 77.5 |
| Exemplary embodiment 26 | Liquid composition 1 | $8.0 \times 10^{-2}$ | 7.0 | 0.51 | 0.19 | Ink 1 | 2.68 | 0.19 | Recording medium 1 | 100 | 25 | 62.5 |
| Exemplary embodiment 27 | Liquid composition 1 | $<5.0 \times 10^{-2}$ | 8.0 | 0.51 | 0.19 | Ink 1 | 2.68 | 0.19 | Recording medium 1 | 110 | 5 | 57.5 |
| Exemplary embodiment 28 | Liquid composition 3 | $<5.0 \times 10^{-2}$ | 4.0 | 2.00 | 0.19 | Ink 1 | 2.68 | 0.76 | Recording medium 1 | 110 | 25 | 67.5 |
| Exemplary embodiment 29 | Liquid composition 4 | $<5.0 \times 10^{-2}$ | 4.0 | 4.97 | 0.19 | Ink 1 | 2.68 | 1.85 | Recording medium 1 | 110 | 25 | 67.5 |
| Exemplary embodiment 30 | Liquid composition 6 | $<5.0 \times 10^{-2}$ | 4.0 | 0.51 | 0.19 | Ink 1 | 2.68 | 0.19 | Recording medium 1 | 110 | 25 | 67.5 |
| Exemplary embodiment 31 | Liquid composition 7 | $<5.0 \times 10^{-2}$ | 4.0 | 0.51 | 0.19 | Ink 1 | 2.68 | 0.19 | Recording medium 1 | 110 | 25 | 67.5 |
| Exemplary embodiment 32 | Liquid composition 8 | $<5.0 \times 10^{-2}$ | 4.0 | 0.51 | 0.19 | Ink 1 | 2.68 | 0.19 | Recording medium 1 | 110 | 25 | 67.5 |
| Exemplary embodiment 33 | Liquid composition 9 | $<5.0 \times 10^{-2}$ | 4.0 | 0.51 | 0.19 | Ink 1 | 2.68 | 0.19 | Recording medium 1 | 110 | 25 | 67.5 |
| Exemplary embodiment 34 | Liquid composition 10 | $<5.0 \times 10^{-2}$ | 4.0 | 0.51 | 0.04 | Ink 1 | 2.68 | 0.19 | Recording medium 1 | 110 | 25 | 67.5 |
| Exemplary embodiment 35 | Liquid composition 11 | $<5.0 \times 10^{-2}$ | 4.0 | 0.51 | 0.19 | Ink 1 | 2.68 | 0.19 | Recording medium 1 | 110 | 25 | 67.5 |
| Exemplary embodiment 36 | Liquid composition 12 | $<5.0 \times 10^{-2}$ | 4.0 | 0.51 | 0.19 | Ink 1 | 2.68 | 0.19 | Recording medium 1 | 110 | 25 | 67.5 |
| Exemplary embodiment 37 | Liquid composition 1 | $<5.0 \times 10^{-2}$ | 4.0 | 0.51 | 0.19 | Ink 2 | 0.56 | 0.90 | Recording medium 1 | 110 | 25 | 67.5 |
| Exemplary embodiment 38 | Liquid composition 1 | $<5.0 \times 10^{-2}$ | 4.0 | 0.51 | 0.19 | Ink 3 | 0.27 | 1.90 | Recording medium 1 | 110 | 25 | 67.5 |
| Exemplary embodiment 39 | Liquid composition 1 | $<5.0 \times 10^{-2}$ | 4.0 | 0.51 | 0.19 | Ink 4 | 3.21 | 0.16 | Recording medium 1 | 110 | 25 | 67.5 |
| Exemplary embodiment 40 | Liquid composition 1 | $<5.0 \times 10^{-2}$ | 4.0 | 0.51 | 0.19 | Ink 5 | 3.70 | 0.14 | Recording medium 1 | 110 | 25 | 67.5 |
| Exemplary embodiment 41 | Liquid composition 14 | $<5.0 \times 10^{-2}$ | 4.0 | 0.51 | 0.19 | Ink 1 | 2.68 | 0.19 | Recording medium 1 | 140 | 25 | 82.5 |
| Exemplary embodiment 42 | Liquid composition 14 | $<5.0 \times 10^{-2}$ | 4.0 | 0.51 | 0.19 | Ink 1 | 2.68 | 0.19 | Recording medium 2 | 140 | 25 | 82.5 |
| Exemplary embodiment 43 | Liquid composition 15 | $<5.0 \times 10^{-2}$ | 9.0 | 0.51 | 0.19 | Ink 1 | 2.68 | 0.19 | Recording medium 1 | 100 | 25 | 62.5 |
| Exemplary embodiment 44 | Liquid composition 15 | $<5.0 \times 10^{-2}$ | 9.0 | 0.51 | 0.19 | Ink 1 | 2.68 | 0.19 | Recording medium 2 | 100 | 25 | 62.5 |

TABLE 5

| Image recording conditions | | | | | | | | | | | | |
|---|---|---|---|---|---|---|---|---|---|---|---|---|
| | Liquid composition | | | | | Ink | | Intermediate image | Conditions in transferring step | | | |
| | | Polymer particles | | | Application | | Application | Application | | Temperature (° C.) | | |
| Embodiment No. | Type | Storage elastic modulus (MPa) E1' | E2' | Application amount (g/m$^2$) | amount of surfactant (g/m$^2$) | Type | amount of polymer particles (g/m$^2$) | amount of polymer particles ratio | Type of recording medium for transfer | Ta | Tb | (Ta + Tb) × 0.5 |
| Comparative Example 1 | Liquid composition 13 | $<5.0 \times 10^{-2}$ | 4.0 | 0.51 | 0.19 | Ink 1 | 0.89 | 0.57 | Recording medium 1 | 110 | 25 | 67.5 |
| Comparative Example 2 | Liquid composition 13 | $<5.0 \times 10^{-2}$ | 4.0 | 0.51 | 0.19 | Ink 1 | 0.89 | 0.57 | Recording medium 2 | 110 | 25 | 67.5 |
| Comparative Example 3 | Liquid composition 1 | $7.0 \times 10^{-1}$ | 8.0 | 0.51 | 0.19 | Ink 1 | 0.89 | 0.57 | Recording medium 1 | 90 | 25 | 57.5 |
| Comparative Example 4 | Liquid composition 1 | $7.0 \times 10^{-1}$ | 8.0 | 0.51 | 0.19 | Ink 1 | 0.89 | 0.57 | Recording medium 2 | 90 | 25 | 57.5 |
| Comparative Example 5 | Liquid composition 1 | $<5.0 \times 10^{-2}$ | $8.0 \times 10^{-2}$ | 0.51 | 0.19 | Ink 1 | 0.89 | 0.57 | Recording medium 1 | 110 | 90 | 100 |
| Comparative Example 6 | Liquid composition 1 | $<5.0\times 10^{-2}$ | $8.0 \times 10^{-2}$ | 0.51 | 0.19 | Ink 1 | 0.89 | 0.57 | Recording medium 2 | 110 | 90 | 100 |
| Comparative Example 7 | Liquid composition 14 | $2.0 \times 10^{-1}$ | 6.0 | 0.51 | 0.19 | Ink 1 | 0.89 | 0.57 | Recording medium 1 | 120 | 25 | 72.5 |
| Comparative Example 8 | Liquid composition 14 | $2.0 \times 10^{-1}$ | 6.0 | 0.51 | 0.19 | Ink 1 | 0.89 | 0.57 | Recording medium 2 | 120 | 25 | 72.5 |
| Comparative Example 9 | Liquid composition 16 | $<5.0 \times 10^{-2}$ | $2.0 \times 10^{-1}$ | 0.51 | 0.19 | Ink 1 | 0.89 | 0.57 | Recording medium 1 | 110 | 25 | 67.5 |
| Comparative Example 10 | Liquid composition 16 | $<5.0 \times 10^{-2}$ | $2.0 \times 10^{-1}$ | 0.51 | 0.19 | Ink 1 | 0.89 | 0.57 | Recording medium 2 | 110 | 25 | 67.5 |
| Comparative Example 11 | Liquid composition 17 | 1.0 | 6.0 | 0.51 | 0.19 | Ink 1 | 0.89 | 0.57 | Recording medium 1 | 110 | 25 | 67.5 |
| Comparative Example 12 | Liquid composition 17 | 1.0 | 6.0 | 0.51 | 0.19 | Ink 1 | 0.89 | 0.57 | Recording medium 2 | 110 | 25 | 67.5 |
| Comparative Example 13 | Liquid composition 2 | $<5.0 \times 10^{-2}$ | 4.0 | 0.30 | 0.19 | Ink 1 | 0.89 | 0.34 | Recording medium 1 | 110 | 25 | 67.5 |
| Comparative Example 14 | Liquid composition 2 | $<5.0 \times 10^{-2}$ | 4.0 | 0.30 | 0.19 | Ink 1 | 0.89 | 0.34 | Recording medium 2 | 110 | 25 | 67.5 |
| Comparative Example 15 | Liquid composition 5 | $<5.0 \times 10^{-2}$ | 4.0 | 6.09 | 0.19 | Ink 1 | 0.89 | 6.82 | Recording medium 1 | 110 | 25 | 67.5 |
| Comparative Example 16 | Liquid composition 5 | $<5.0 \times 10^{-2}$ | 4.0 | 6.09 | 0.19 | Ink 1 | 0.89 | 6.82 | Recording medium 2 | 110 | 25 | 67.5 |
| Comparative Example 17 | Liquid composition 1 | $<5.0 \times 10^{-2}$ | 4.0 | 0.51 | 0.19 | Ink 6 | — | — | Recording medium 1 | 110 | 25 | 67.5 |
| Comparative Example 18 | Liquid composition 1 | $<5.0 \times 10^{-2}$ | 4.0 | 0.51 | 0.19 | Ink 6 | — | — | Recording medium 2 | 110 | 25 | 67.5 |
| Comparative Example 19 | Liquid composition 13 | $<5.0 \times 10^{-2}$ | 4.0 | 0.51 | 0.19 | Ink 1 | 2.68 | 0.19 | Recording medium 1 | 110 | 25 | 67.5 |
| Comparative Example 20 | Liquid composition 13 | $<5.0 \times 10^{-2}$ | 4.0 | 0.51 | 0.19 | Ink 1 | 2.68 | 0.19 | Recording medium 2 | 110 | 25 | 67.5 |
| Comparative Example 21 | Liquid composition 1 | $7.0 \times 10^{-1}$ | 8.0 | 0.51 | 0.19 | Ink 1 | 2.68 | 0.19 | Recording medium 1 | 90 | 25 | 57.5 |
| Comparative Example 22 | Liquid composition 1 | $7.0 \times 10^{-1}$ | 8.0 | 0.51 | 0.19 | Ink 1 | 2.68 | 0.19 | Recording medium 2 | 90 | 25 | 57.5 |
| Comparative Example 23 | Liquid composition 1 | $<5.0 \times 10^{-2}$ | $8.0 \times 10^{-2}$ | 0.51 | 0.19 | Ink 1 | 2.68 | 0.19 | Recording medium 1 | 110 | 90 | 100 |
| Comparative Example 24 | Liquid composition 1 | $<5.0 \times 10^{-2}$ | $8.0 \times 10^{-2}$ | 0.51 | 0.19 | Ink 1 | 2.68 | 0.19 | Recording medium 2 | 110 | 90 | 100 |
| Comparative Example 25 | Liquid composition 14 | $2.0 \times 10^{-1}$ | 6.0 | 0.51 | 0.19 | Ink 1 | 2.68 | 0.19 | Recording medium 1 | 120 | 25 | 72.5 |
| Comparative Example 26 | Liquid composition 14 | $2.0 \times 10^{-1}$ | 6.0 | 0.51 | 0.19 | Ink 1 | 2.68 | 0.19 | Recording medium 2 | 120 | 25 | 72.5 |
| Comparative Example 27 | Liquid composition 16 | $<5.0 \times 10^{-2}$ | $2.0 \times 10^{-1}$ | 0.51 | 0.19 | Ink 1 | 2.68 | 0.19 | Recording medium 1 | 110 | 25 | 67.5 |
| Comparative Example 28 | Liquid composition 16 | $<5.0 \times 10^{-2}$ | $2.0 \times 10^{-1}$ | 0.51 | 0.19 | Ink 1 | 2.68 | 0.19 | Recording medium 2 | 110 | 25 | 67.5 |
| Comparative Example 29 | Liquid composition 17 | 1.0 | 6.0 | 0.51 | 0.19 | Ink 1 | 2.68 | 0.19 | Recording medium 1 | 110 | 25 | 67.5 |
| Comparative Example 30 | Liquid composition 17 | 1.0 | 6.0 | 0.51 | 0.19 | Ink 1 | 2.68 | 0.19 | Recording medium 2 | 110 | 25 | 67.5 |
| Comparative Example 31 | Liquid composition 2 | $<5.0 \times 10^{-2}$ | 4.0 | 0.30 | 0.19 | Ink 1 | 2.68 | 0.11 | Recording medium 1 | 110 | 25 | 67.5 |
| Comparative Example 32 | Liquid composition 2 | $<5.0 \times 10^{-2}$ | 4.0 | 0.30 | 0.19 | Ink 1 | 2.68 | 0.11 | Recording medium 2 | 110 | 25 | 67.5 |

TABLE 5-continued

| Image recording conditions | | | | | | | | | | | | |
|---|---|---|---|---|---|---|---|---|---|---|---|---|
| | Liquid composition | | | | | Ink | | Intermediate image | | | | |
| | | Polymer particles | | | Application | | Application | Application | Conditions in transferring step | | | |
| | | | | Application | | | amount of | amount of | Type of | Temperature (° C.) | | |
| Embodiment | | Storage elastic modulus (MPa) | | amount | amount of surfactant | | polymer particles | polymer particles | recording medium for | | | (Ta + Tb) × |
| No. | Type | E1' | E2' | (g/m²) | (g/m²) | Type | (g/m²) | ratio | transfer | Ta | Tb | 0.5 |
| Comparative Example 33 | Liquid composition 5 | $<5.0 \times 10^{-2}$ | 4.0 | 6.09 | 0.19 | Ink 1 | 2.68 | 2.27 | Recording medium 1 | 110 | 25 | 67.5 |
| Comparative Example 34 | Liquid composition 5 | $<5.0 \times 10^{-2}$ | 4.0 | 6.09 | 0.19 | Ink 1 | 2.68 | 2.27 | Recording medium 2 | 110 | 25 | 67.5 |

In the tables, the "Recording medium 1" is "OK Prince High Quality (uncoated paper, basis weight: 127.9 g/m², manufactured by Oji Paper Co., Ltd.)" (arithmetic surface roughness Ra: 3.2 μm), and the "Recording medium 2" is "Tokubishi Art double-sided N (coated paper, basis weight 127.9 g/m², manufactured by Mitsubishi Paper Mills, Ltd.)" (arithmetic surface roughness Ra: 0.6 μm). In the tables, the "Polymer particle application amount ratio" refers to "the application amount of polymer particles in the liquid composition/the application amount of polymer particles in the ink", that is, "the application amount of second polymer particles/the application amount of first polymer particles". The tables also list the storage elastic moduli E1' and E2' of the polymer particles in the liquid composition at Ta and ((Ta+Tb)*0.5), respectively, in each embodiment. E1' of "<0.05" refers to "E1'<0.05 MPa". In the embodiments of the present invention, the storage elastic moduli were measured with a dynamic viscoelastic analyzer DVA-200 (manufactured by IT Keisoku Seigyo Co., Ltd.). The expression "<0.05" means that the storage elastic modulus E1' was below the detection limit of the analyzer and could not be measured.

TABLE 6

| Evaluation results | | | |
|---|---|---|---|
| Embodiment No. | Intermediate image quality | Transfer efficiency | Final image quality |
| Exemplary embodiment 1 | A | A | A |
| Exemplary embodiment 2 | A | A | A |
| Exemplary embodiment 3 | A | A | A |
| Exemplary embodiment 4 | A | A | A |
| Exemplary embodiment 5 | A | A | A |
| Exemplary embodiment 6 | A | A | A |
| Exemplary embodiment 7 | B | A | B |
| Exemplary embodiment 8 | B | B | B |
| Exemplary embodiment 9 | A | B | B |
| Exemplary embodiment 10 | A | A | A |
| Exemplary embodiment 11 | B | A | B |
| Exemplary embodiment 12 | B | A | B |
| Exemplary embodiment 13 | A | A | A |
| Exemplary embodiment 14 | B | A | B |
| Exemplary embodiment 15 | A | A | A |
| Exemplary embodiment 16 | B | A | B |
| Exemplary embodiment 17 | A | A | A |
| Exemplary embodiment 18 | A | A | A |
| Exemplary embodiment 19 | B | B | B |
| Exemplary embodiment 20 | B | A | B |
| Exemplary embodiment 21 | A | A | A |

TABLE 6-continued

| Evaluation results | | | |
|---|---|---|---|
| Embodiment No. | Intermediate image quality | Transfer efficiency | Final image quality |
| Exemplary embodiment 22 | A | A | A |
| Exemplary embodiment 23 | A | A | A |
| Exemplary embodiment 24 | A | A | A |
| Exemplary embodiment 25 | A | A | A |
| Exemplary embodiment 26 | A | A | A |
| Exemplary embodiment 27 | A | A | A |
| Exemplary embodiment 28 | A | A | A |
| Exemplary embodiment 29 | A | A | A |
| Exemplary embodiment 30 | B | B | B |
| Exemplary embodiment 31 | A | B | B |
| Exemplary embodiment 32 | A | A | A |
| Exemplary embodiment 33 | B | A | B |
| Exemplary embodiment 34 | B | B | B |
| Exemplary embodiment 35 | A | A | A |
| Exemplary embodiment 36 | B | A | B |
| Exemplary embodiment 37 | A | A | A |
| Exemplary embodiment 38 | A | A | A |
| Exemplary embodiment 39 | A | A | A |
| Exemplary embodiment 40 | A | B | B |
| Exemplary embodiment 41 | B | B | B |
| Exemplary embodiment 42 | B | B | B |
| Exemplary embodiment 43 | A | A | A |
| Exemplary embodiment 44 | A | A | A |
| Comparative Example 1 | C | C | C |
| Comparative Example 2 | C | B | C |
| Comparative Example 3 | A | D | C |
| Comparative Example 4 | A | C | C |
| Comparative Example 5 | A | D | C |
| Comparative Example 6 | A | C | C |
| Comparative Example 7 | A | D | C |
| Comparative Example 8 | A | C | C |
| Comparative Example 9 | A | D | C |
| Comparative Example 10 | A | C | C |
| Comparative Example 11 | A | D | C |
| Comparative Example 12 | A | C | C |
| Comparative Example 13 | A | D | C |
| Comparative Example 14 | A | C | C |
| Comparative Example 15 | C | A | C |
| Comparative Example 16 | C | A | C |
| Comparative Example 17 | C | A | C |
| Comparative Example 18 | C | A | C |
| Comparative Example 19 | C | C | C |
| Comparative Example 20 | C | B | C |
| Comparative Example 21 | A | D | C |
| Comparative Example 22 | A | C | C |
| Comparative Example 23 | A | D | C |
| Comparative Example 24 | A | C | C |
| Comparative Example 25 | A | D | C |
| Comparative Example 26 | A | C | C |

TABLE 6-continued

| Evaluation results | | | |
|---|---|---|---|
| Embodiment No. | Intermediate image quality | Transfer efficiency | Final image quality |
| Comparative Example 27 | A | D | C |
| Comparative Example 28 | A | C | C |
| Comparative Example 29 | A | D | C |
| Comparative Example 30 | A | C | C |
| Comparative Example 31 | A | D | C |
| Comparative Example 32 | A | C | C |
| Comparative Example 33 | C | A | C |
| Comparative Example 34 | C | A | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-120002 filed Jun. 10, 2014, which is hereby incorporated by reference herein in its entirety.

What is claimed is:

1. An image-recording method comprising:

a liquid composition applying process for applying a liquid composition to an intermediate transfer member;

an intermediate image forming process for forming an intermediate image by applying an ink to the intermediate transfer member to which the liquid composition has been applied; and a transferring process for transferring the intermediate image to a recording medium, wherein the ink contains a coloring material and first polymer particles, the liquid composition contains a reaction agent and second polymer particles that satisfy storage elastic modulus relationships represented by the following formula (1), and the amount of the second polymer particles applied to the intermediate transfer member in the intermediate image forming process is 0.5 $g/m^2$ or more and 5.0 $g/m^2$ or less:

$$E1' \leq 0.1 \text{ MPa}, E2' \geq 1.0 \text{ MPa} \quad \text{Formula (1):}$$

wherein E1' denotes a storage elastic modulus at Ta, and E2' denotes a storage elastic modulus at ((Ta+Tb)*0.5), Ta denotes the temperature of the intermediate image before transfer in the transferring process, and Tb denotes the temperature of the recording medium before transfer in the transferring process.

2. The image-recording method according to claim 1, wherein the second polymer particles have an average particle size of 0.03 μm or more and 1.0 μm or less.

3. The image-recording method according to claim 1, wherein the reaction agent is at least one selected from polyvalent metal ions and organic acids.

4. The image-recording method according to claim 1, wherein the liquid composition contains at least one selected from fluorinated surfactants and silicone surfactants.

5. The image-recording method according to claim 4, wherein the total amount of fluorinated surfactants and silicone surfactants applied to the intermediate transfer member is 0.1 $g/m^2$ or more and 1.0 $g/m^2$ or less.

6. The image-recording method according to claim 1, wherein the ratio of the amount ($g/m^2$) of the second polymer particles to the amount ($g/m^2$) of the first polymer particles applied to the intermediate transfer member is 0.15 or more and 2.80 or less.

7. The image-recording method according to claim 1, wherein the second polymer particles are nonionic polymer particles.

8. The image-recording method according to claim 1, wherein a period during which the intermediate transfer member comes into contact with the recording medium with the intermediate image interposed therebetween and is separated from the recording medium in the transferring process is 1 millisecond or more and 100 milliseconds or less.

9. The image-recording method according to claim 1, wherein the recording medium has an arithmetic surface roughness Ra of 1 μm or more and 5 μm or less.

10. The image-recording method according to claim 1, wherein the second polymer particles are nonionic polymer particles having an average particle size of 0.03 μm or more and 1.0 μm or less.

11. The image-recording method according to claim 1, wherein the second polymer particles are polyolefin wax, paraffin wax or carnauba wax.

12. The image-recording method according to claim 1, wherein the second polymer particles have a melting point equal to or lower than Ta.

13. The image-recording method according to claim 1, wherein the second polymer particles have a melting point of 50° C. or more and 160° C. or less.

14. The image-recording method according to claim 1, wherein the first polymer particles have an average particle size of 10 nm or more and 1000 nm or less.

15. The image-recording method according to claim 1, wherein the first polymer particles have a weight-average molecular weight of 1,000 or more and 2,000,000 or less.

16. The image-recording method according to claim 1, wherein the first polymer particles have a minimum film-forming temperature of 20° C. or more and 100° C. or less.

17. The image-recording method according to claim 1, wherein the first polymer particles are acrylic polymer particles or urethane polymer particles.

18. The image-recording method according to claim 1, wherein the first polymer particles are acrylic polymer particles or urethane polymer particles, and the second polymer particles are polyolefin wax, paraffin wax or carnauba wax.

* * * * *